US011128053B2

(12) United States Patent
Nakamoto et al.

(10) Patent No.: US 11,128,053 B2
(45) Date of Patent: Sep. 21, 2021

(54) ARRAY ANTENNA DEVICE

(71) Applicant: Mitsubishi Electric Corporation, Tokyo (JP)

(72) Inventors: Narihiro Nakamoto, Tokyo (JP); Satoshi Yamaguchi, Tokyo (JP); Toru Fukasawa, Tokyo (JP); Masataka Otsuka, Tokyo (JP); Hiroaki Miyashita, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 153 days.

(21) Appl. No.: 16/605,482

(22) PCT Filed: Jan. 31, 2018

(86) PCT No.: PCT/JP2018/003212
§ 371 (c)(1),
(2) Date: Oct. 15, 2019

(87) PCT Pub. No.: WO2018/211747
PCT Pub. Date: Nov. 22, 2018

(65) Prior Publication Data

US 2020/0044358 A1 Feb. 6, 2020

(30) Foreign Application Priority Data

May 19, 2017 (WO) ..... PCT/JP2017/018872

(51) Int. Cl.
*H01Q 21/06* (2006.01)
*H01Q 3/38* (2006.01)
(Continued)

(52) U.S. Cl.
CPC ..... *H01Q 21/06* (2013.01); *H01P 1/182* (2013.01); *H01P 5/107* (2013.01); *H01Q 3/34* (2013.01);
(Continued)

(58) Field of Classification Search
CPC .... H01Q 21/06; H01Q 21/0037; H01Q 21/08; H01Q 21/0012; H01Q 13/22; H01Q 3/38; H01Q 3/34; H01P 5/107; H01P 1/182
(Continued)

(56) References Cited

U.S. PATENT DOCUMENTS 5,453,755 A * 9/1995 Nakano ..... H01Q 11/08 343/872
5,519,409 A * 5/1996 Uematsu ..... H01Q 1/3275 343/771
2008/0099447 A1* 5/2008 Ando ..... H01J 37/32192 219/121.43
2010/0001916 A1* 1/2010 Yamaguchi ..... H01Q 13/12 343/771
(Continued)

FOREIGN PATENT DOCUMENTS

CA 1331055 C 7/1994
GB 2 227 369 A 7/1990
(Continued)

*Primary Examiner* — Hai V Tran
(74) *Attorney, Agent, or Firm* — Birch, Stewart, Kolasch & Birch, LLP.

(57) ABSTRACT

Included are: a waveguide in which multiple probe inserting holes are provided in a first wall surface, and multiple connection shaft inserting holes are provided in a second wall surface; multiple feed probes each of which is inserted in one of the probe inserting holes, and to a first end of each of which one of multiple circularly polarized element antennas is connected; multiple connection shafts each of which is inserted in one of the connection shaft inserting holes, and a third end of each of which is connected to a second end of one of the feed probes; multiple rotation shafts, a fifth end of each of which is connected to a fourth end of one of the connection shafts; multiple rotation devices each of which rotates one of the rotation shafts; and a control device that individually controls rotation of the rotation devices.

16 Claims, 11 Drawing Sheets

(51) Int. Cl.

| | |
|---|---|
| ***H01Q 3/34*** | (2006.01) |
| ***H01P 5/107*** | (2006.01) |
| ***H01Q 21/00*** | (2006.01) |
| ***H01P 1/18*** | (2006.01) |
| ***H01Q 13/22*** | (2006.01) |
| ***H01Q 21/08*** | (2006.01) |

(52) U.S. Cl.
CPC ..... *H01Q 3/38* (2013.01); *H01Q 13/22* (2013.01); *H01Q 21/0012* (2013.01); *H01Q 21/0031* (2013.01); *H01Q 21/0037* (2013.01); *H01Q 21/08* (2013.01)

(58) Field of Classification Search
USPC ..... 343/893
See application file for complete search history.

(56) References Cited

U.S. PATENT DOCUMENTS

| | | | | |
|---|---|---|---|---|
| 2013/0271338 | A1* | 10/2013 | Mastoropoulos ..... | H01Q 11/08 343/848 |
| 2019/0157730 | A1* | 5/2019 | Oppenlaender ..... | H01Q 3/34 |

FOREIGN PATENT DOCUMENTS

| | | | |
|---|---|---|---|
| JP | 61-154203 | A | 7/1986 |
| JP | 2-189008 | A | 7/1990 |
| JP | 3-58504 | A | 3/1991 |
| JP | 7-70904 | B2 | 7/1995 |
| JP | 11-317619 | A | 11/1999 |
| WO | WO 2018/211695 | A1 | 11/2018 |

* cited by examiner

ARRAY ANTENNA DEVICE

TECHNICAL FIELD

The present invention relates to an array antenna device that includes a plurality of circularly polarized element antennas.

BACKGROUND ART

In recent years, a phased array antenna capable of scanning a radiation pattern or controlling directivity is widely used as an antenna device used for wireless communication or radars in order to cope with improvements in functions and performance of wireless communication or radars.

The phased array antenna is an array antenna device in which a plurality of element antennas is arranged and a phase shifter is connected to each of the element antennas.

As the phase shifter of the phased array antenna, a digital phase shifter is widely used which changes a radiation phase of an element antenna by switching transmission lines using a semiconductor switch such as a diode or a transistor.

The digital phase shifter can be miniaturized by chipping. In addition, it is easy to control the digital phase shifter, because the digital phase shifter can electronically control pass phase.

However, the digital phase shifter has a disadvantage that transmission loss is increased because it is necessary to provide a large number of semiconductor switches on the transmission lines.

Patent Literature 1 below discloses an array antenna device that controls radiation phases of a plurality of element antennas without using a digital phase shifter.

The array antenna device disclosed in Patent Literature 1 includes a waveguide formed of parallel metal flat plates, and a plurality of holes is provided in the parallel metal flat plates forming the waveguide.

A central axis of each of multiple circularly polarized element antennas is inserted into the hole provided in the metal flat plate via insulating coupling, thereby penetrating through the parallel metal flat plate.

In addition, the central axis of each of the circularly polarized element antennas is attached to a gear provided on a back surface of the corresponding antenna, and the gear is arranged to mesh with a worm shaft rotated by a motor.

Thus, the motor rotates the worm shaft after manufacturing the array antenna device or during operation of a communication system or a radar system using the array antenna device, and thereby it is possible to rotate the circularly polarized element antennas simultaneously in the same direction at the same speed.

Rotating the multiple circularly polarized element antennas makes it possible to adjust a reference phase direction of each of the multiple circularly polarized element antennas.

CITATION LIST

Patent Literatures

Patent Literature 1: Japanese Patent Application Laid-open No. 11-317619

SUMMARY OF INVENTION

Technical Problem

The conventional array antenna device is configured as described above, so that a reference phase direction of a plurality of circularly polarized element antennas can be adjusted after manufacturing the array antenna device or during operation of a communication system or a radar system using the array antenna device. However, since the circularly polarized element antennas rotate simultaneously in the same direction at the same speed, only the reference phase direction changes, and the phases of the circularly polarized element antennas cannot be adjusted individually. Therefore, excitation phase distribution of the array antenna device does not change, so that there is a problem in that a desired radiation pattern cannot be formed.

The present invention has been made to solve the problem as described above, and it is an object of the present invention to obtain an array antenna device capable of individually adjusting phases of a plurality of circularly polarized element antennas.

Solution to Problem

The array antenna device according to the present invention includes: a waveguide in which a plurality of probe inserting holes is provided in a first wall surface, and a plurality of connection shaft inserting holes is provided in a second wall surface facing the first wall surface; a plurality of feed probes each of which is inserted in one of the probe inserting holes, and to a first end of each of which at least one of multiple circularly polarized element antennas is connected; a plurality of connection shafts each of which is inserted in one of the connection shaft inserting holes, and a third end of each of which is connected to a second end of one of the feed probes;

a plurality of rotation shafts, a fifth end of each of which is connected to a fourth end of one of the connection shafts; a plurality of rotation devices each of which rotates one of the rotation shafts; and a control device that individually controls rotation of the rotation devices.

Advantageous Effects of Invention

The present invention achieves an effect of adjusting phases of a plurality of circularly polarized element antennas individually.

DESCRIPTION OF EMBODIMENTS

Hereinafter, in order to describe the present invention in more detail, each embodiment of the present invention will be described with reference to the attached drawings.

First Embodiment

Figure 1:
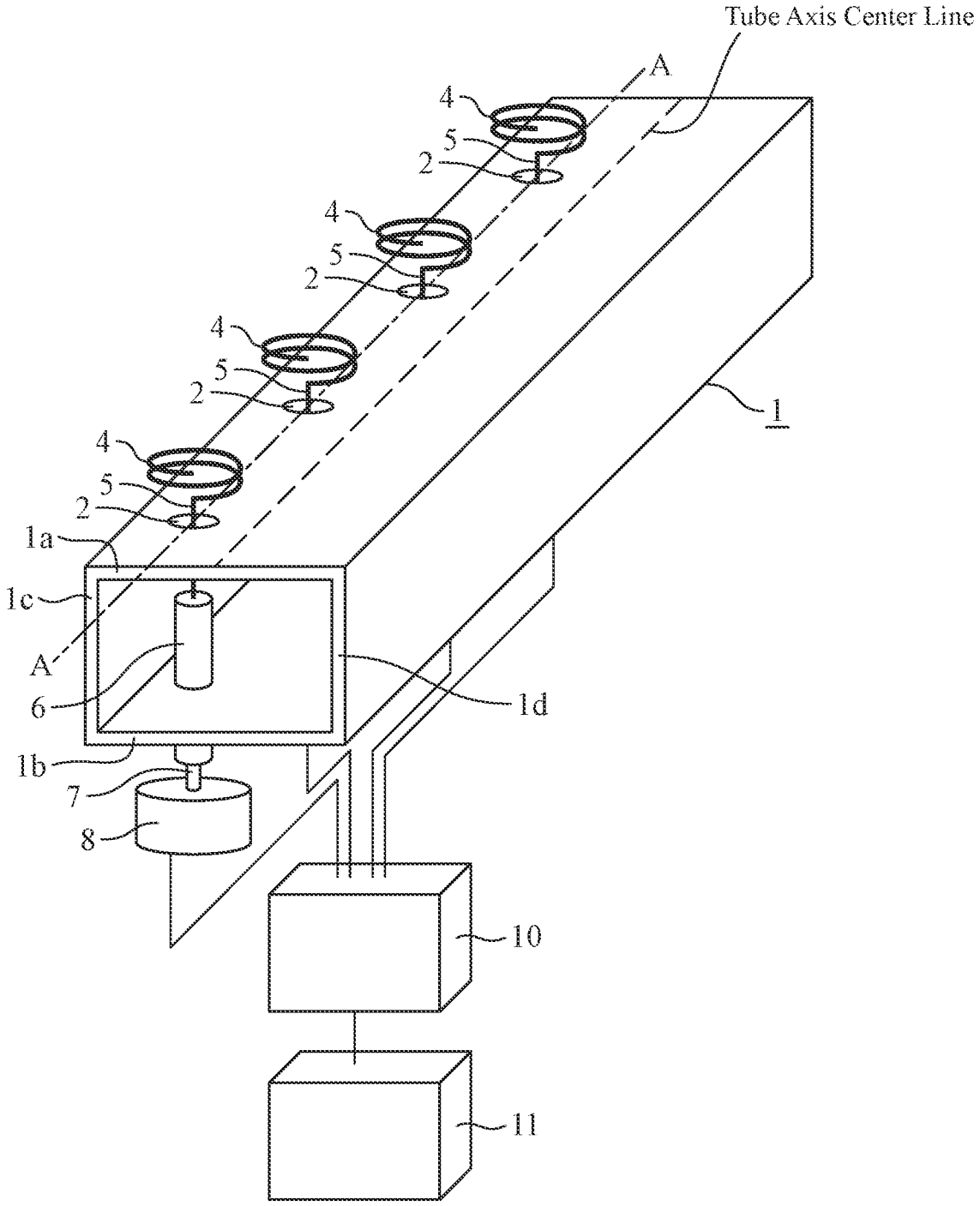
FIG. 1 is a perspective view illustrating an array antenna device according to a first embodiment of the present invention.

FIG. 1 is a perspective view illustrating an array antenna device according to a first embodiment of the present invention.

Figure 2:
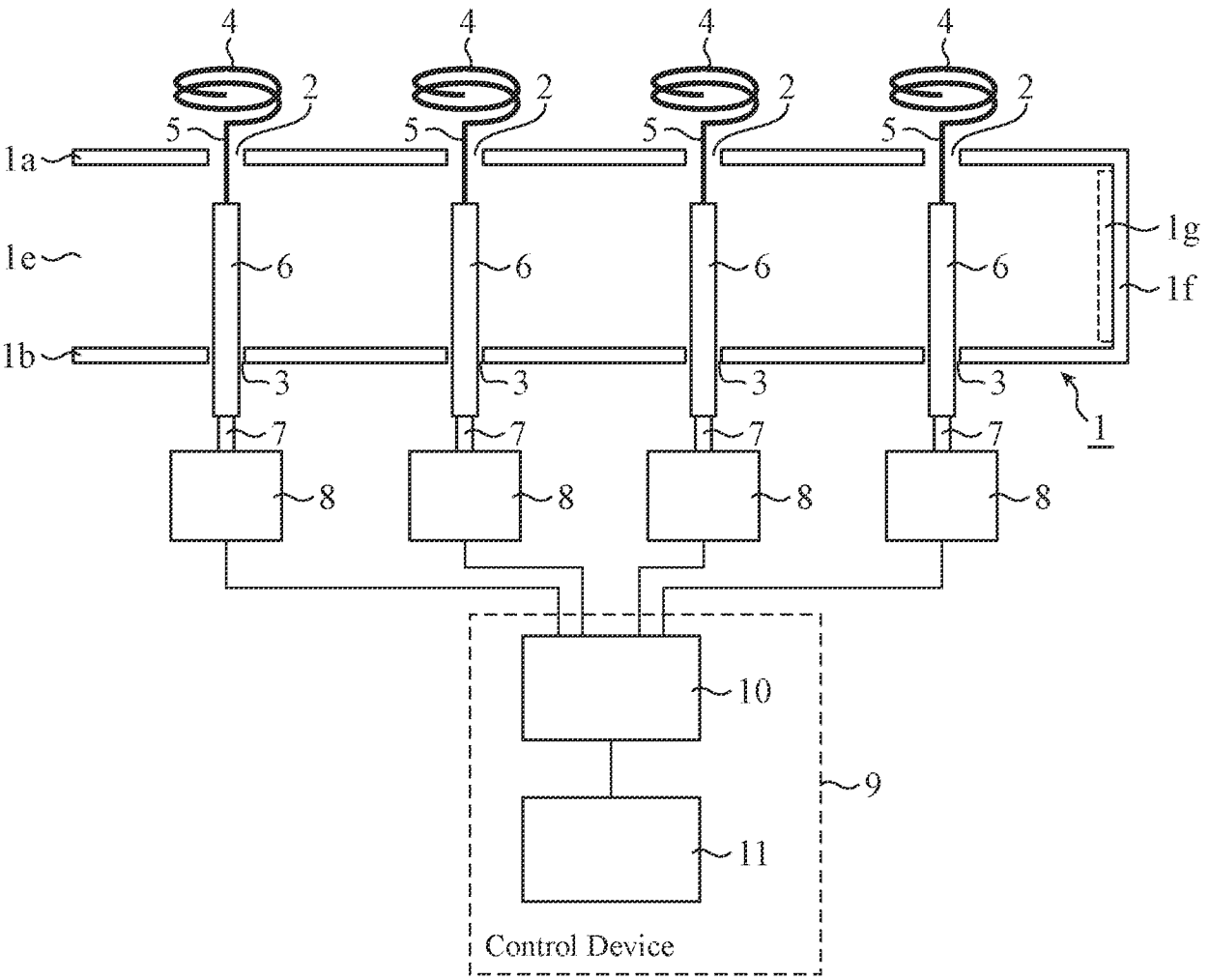
FIG. 2 is a cross-sectional view of the array antenna device taken along line A-A of FIG. 1.

FIG. 2 is a cross-sectional view of the array antenna device taken along line A-A of FIG. 1.

In FIGS. 1 and 2, a waveguide 1 is a rectangular waveguide including two wide wall surfaces and two narrow wall surfaces having smaller areas than the wide wall surfaces.

The two wide wall surfaces face each other, one of the two wide wall surfaces is a first wall surface 1*a*, and the other of the two wide wall surfaces is a second wall surface 1*b*.

The two narrow wall surfaces face each other, one of the two narrow wall surfaces is a side wall 1*c*, and the other of the two narrow wall surfaces is a side wall 1*d*.

Although FIG. 1 is the example in which the waveguide 1 includes two wide wall surfaces and two narrow wall surfaces, the two wide wall surfaces and the two narrow wall surfaces may have the same area.

The waveguide 1 includes a feed terminal 1*e* to which high frequency signals are input/output, and a shorting wall 1*f* is provided at an end portion of the waveguide 1 facing the feed terminal 1*e*.

Probe inserting holes 2 are holes provided in the first wall surface 1*a* of the waveguide 1 so that feed probes 5 of circularly polarized element antennas 4 can be inserted thereinto.

In FIG. 1, a plurality of the probe inserting holes 2 is provided in the first wall surface 1*a* at predetermined intervals so as to correspond to element arrangement of the circularly polarized element antennas 4.

The diameter of each probe inserting hole 2 is sufficiently smaller than wavelengths of high frequency signals propagating in the waveguide 1.

Connection shaft inserting holes 3 are holes provided in the second wall surface 1*b* of the waveguide 1 so that connection shafts 6 can be inserted thereinto.

The diameter of each connection shaft inserting hole 3 is sufficiently smaller than the wavelengths of the high frequency signals propagating in the waveguide 1.

The circularly polarized element antenna 4 is a helical antenna in which a conducting wire has a helical shape, and the feed probe 5 is connected to an end of the circularly polarized element antenna 4.

The feed probe 5 is a conductor one end of which is connected to the end of the circularly polarized element antenna 4, and is inserted in the probe inserting hole 2 provided in the first wall surface 1*a* of the waveguide 1.

An insertion length of the feed probe 5 inside the waveguide 1 is determined on the basis of excitation amplitude distribution of the array antenna device and an impedance characteristic at the feed terminal 1*e* of the waveguide 1.

Each connection shaft 6 is formed of, for example, an insulator such as a dielectric.

The connection shaft 6 is inserted in the connection shaft inserting hole 3 provided in the second wall surface 1*b* of the waveguide 1, and one end thereof is connected to the other end of the feed probe 5.

As a method for connecting the feed probe 5 and the connection shaft 6, for example, a method is possible in which a screw hole is provided in the connection shaft 6 and an external thread is provided on the feed probe 5, and thereby the feed probe 5 and the connection shaft 6 are screwed together.

In addition, a method is possible in which a fitting hole is provided in the connection shaft 6 and the feed probe 5 is press-fitted into the fitting hole in the connection shaft 6.

Furthermore, a method is possible in which a conductor pattern which constitutes the feed probe 5 is formed on the connection shaft 6.

Rotation shafts 7 are each formed of a metal conductor, and one end thereof is connected to the other end of the connection shaft 6.

A method for connecting the connection shaft 6 and the rotation shaft 7 is similar to the method for connecting the feed probe 5 and the connection shaft 6.

Positions where the connection shafts 6 and the rotation shafts 7 are connected are outside the waveguide 1.

Rotation devices 8 are each implemented by, for example, a motor such as a direct-current motor, an alternating-current motor, or a stepping motor.

The rotation devices 8 each rotate the circularly polarized element antenna 4 by rotating the rotation shaft 7.

A control device 9 includes a rotary drive device 10 and a rotation control device 11, and is a device that controls the rotation of the plurality of rotation devices 8 individually.

The rotary drive device 10 is a motor driver implemented, for example, by a semiconductor integrated circuit, a network interface such as a communication device, a power supply circuit, and a drive current generation circuit.

The rotary drive device 10 drives the rotation devices 8 so that the rotation shafts 7 rotate to a predetermined angle by outputting, to the rotation devices 8, a drive current corresponding to a command value output from the rotation control device 11.

The rotation control device 11 includes, for example, a storage device such as a random access memory (RAM) or a hard disk, a semiconductor integrated circuit or a one-chip microcomputer on which a central processing unit (CPU) is mounted, a user interface such as a keyboard or a mouse, and a network interface such as a communication device.

The rotation control device 11 calculates rotation angles of the rotation shafts 7 and the like on the basis of information input through the user interface or information stored in the storage device, for example, and outputs a command value that indicates the rotation angles thus calculated and the like to the rotary drive device 10 through the network interface.

Next, operation will be described.

Each of areas of the first wall surface 1*a* and the second wall surface 1*b* in the waveguide 1 is equal to or larger than each of areas of the side wall 1*c* and the side wall 1*d*.

Therefore, when a high frequency signal is input into the waveguide 1 from the feed terminal 1*e* of the waveguide 1, an electromagnetic field distribution mainly including an electric field parallel to the wall surfaces of the side walls 1*c* and 1*d* is generated inside the waveguide 1.

The feed probes 5 of the circularly polarized element antennas 4 are inserted in the waveguide 1 substantially parallel to the side walls 1*c* and 1*d* of the waveguide 1, and therefore the feed probes 5 couple with an electric field generated in the waveguide 1.

As a result, a current flows through each feed probe 5, so that power is supplied to the corresponding circularly polarized element antenna 4. Thus, a circularly polarized wave is radiated into space from the circularly polarized element antenna 4.

At that time, phase differences among elements in the circularly polarized waves radiated from the respective circularly polarized element antennas 4 are determined by phase differences in currents flowing through the respective feed probes 5 and differences in physical rotation angles among the respective circularly polarized element antennas 4.

The phase differences in the currents flowing through the respective feed probes 5 are determined by the electromagnetic field distribution inside the waveguide 1 and positions of the respective circularly polarized element antennas 4, and can be obtained by a theoretical method or electromagnetic field simulation, and the like.

The circularly polarized element antennas 4 are each connected to the corresponding rotation shaft 7 via the feed probe 5 and the connection shaft 6, and the rotation shafts 7 are each connected to the corresponding rotation device 8.

Therefore, the control device 9 can individually control the rotation angles of the respective circularly polarized element antennas 4 by controlling the respective rotation devices 8 individually.

The rotation control device 11 of the control device 9 calculates the excitation phase distribution of the array antenna device for forming a desired radiation pattern.

The excitation phase distribution of the array antenna device can be calculated, for example, from information input through the user interface or information stored in the storage device. Because a calculation process itself of the excitation phase distribution is a known technique, a detailed description thereof will be omitted.

Examples of information used to calculate the excitation phase distribution include information on frequencies of high frequency signals, information on the arrangement of the plurality of circularly polarized element antennas 4, information on the insertion length of each feed probe 5 inside the waveguide 1, information on a desired radiation pattern, and information on a switching speed of radiation patterns. The information on a desired radiation pattern corresponds to conditions regarding beam scanning directions, side lobes, nulls, and the like.

In addition, the rotation control device 11 calculates the rotation angles of the rotation shafts 7 corresponding to the excitation phase distribution in consideration of the phase differences in the currents flowing through the respective feed probes 5, and calculates the rotational speeds of the rotation shafts 7 corresponding to a switching time of predetermined radiation patterns.

Because a calculation process itself of the rotation angles of the rotation shafts 7 corresponding to the excitation phase distribution and the rotational speeds of the rotation shafts 7 is a known technique, detailed descriptions thereof will be omitted.

The rotation control device 11 outputs a command value indicating the rotation angles of the rotation shafts 7 and the rotational speeds of the rotation shafts 7 thus calculated to the rotary drive device 10 through the network interface.

The rotary drive device 10 generates a drive current necessary to rotationally drive each rotation shaft 7 on the basis of the command value output from the rotation control device 11, and outputs the generated drive current to each rotation device 8.

As a result, the respective circularly polarized element antennas 4 are individually rotated at the rotation angles and the rotational speeds calculated by the rotation control device 11, and thereby the respective circularly polarized element antennas 4 are arranged at angles corresponding to the excitation phase distribution necessary for forming a desired radiation pattern.

Thus, the phase differences among elements in the circularly polarized waves radiated from the respective circularly polarized element antennas 4 become identical with the above-described excitation phase distribution, so that the desired radiation pattern is formed.

The desired radiation pattern can be formed by appropriately changing the command value from the rotation control device 11 after manufacturing the array antenna device or during operation of a communication system or a radar system using the array antenna device. This can be achieved by appropriately changing an input value from the user interface of the rotation control device 11, or by appropriately reading information stored in the storage device of the rotation control device 11.

The high frequency signals propagating in the waveguide 1 leak outside the waveguide 1, to no small extent, from the connection shaft inserting holes 3 provided in the second wall surface 1*b* of the waveguide 1.

However, since the diameter of each connection shaft inserting hole 3 is sufficiently small compared to the wavelength of the high frequency signals propagating in the waveguide 1, there are not many high frequency signals leaking outside the waveguide 1 from the connection shaft inserting holes 3. In addition, the positions where the connection shafts 6 and the rotation shafts 7 are connected are outside the waveguide 1.

Therefore, there is almost no coupling between the electric field generated inside the waveguide 1 and the rotation shafts 7. Thus, an array antenna device with high power efficiency can be achieved.

As apparent from the above, according to the first embodiment, the configuration is employed which includes: the waveguide 1 in which the plurality of probe inserting holes 2 is provided in the first wall surface 1*a*, and the plurality of connection shaft inserting holes 3 is provided in the second wall surface 1*b* facing the first wall surface 1*a*; the plurality of feed probes 5 each of which is inserted in one of the probe inserting holes 2, and to one end of each of which any one of multiple circularly polarized element antennas 4 is connected; a plurality of connection shafts 6 each of which is inserted in one of the connection shaft inserting holes 3, and one end of each of which is connected to the other end of each of the feed probes 5; the plurality of rotation shafts 7 one end of each of which is connected to the other end of one of the connection shafts 6; the plurality of rotation devices 8 each of which rotates one of the rotation shafts 7; and the control device 9 that individually controls rotation of the rotation devices 8. Thus, the phases of the circularly polarized element antennas 4 can be adjusted individually.

In the first embodiment, the example is indicated in which the circularly polarized element antenna 4 is a helical antenna, but there is no limitation thereto. For example, the circularly polarized element antenna 4 may be a patch antenna, a spiral antenna, or a curl antenna.

In the first embodiment, the example is indicated in which the circularly polarized element antennas 4 are arranged at equal intervals on one side of the tube axis center line of the waveguide 1.

This is merely an example, and adjacent circularly polarized element antennas 4 may be arranged to be opposite to each other with respect to the tube axis center line, for example.

In addition, the circularly polarized element antennas 4 may be arranged so that intervals between the adjacent circularly polarized element antennas 4 are different from one another.

Furthermore, the circularly polarized element antennas 4 may be arranged at any position where no physical interference is caused.

In the first embodiment, the example is indicated in which the insertion lengths of the plurality of feed probes 5 inside the waveguide 1 are all the same length, but it is satisfactory as long as the insertion lengths are determined on the basis of the excitation amplitude distribution of the array antenna device and the impedance characteristic at the feed terminal 1*e* of the waveguide 1. Therefore, the insertion lengths of the plurality of feed probes 5 inside the waveguide 1 may be different from one another.

In the first embodiment, the example is indicated in which the shorting wall 1*f* is provided at the end portion of the waveguide 1 facing the feed terminal 1*e*, but a radio wave absorber 1*g* may be provided on the shorting wall 1*f*.

When the radio wave absorber 1*g* is provided on the shorting wall 1*f*, power of the high frequency signals which have not been radiated from the plurality of circularly polarized element antennas 4 and remain inside the waveguide 1 can be absorbed.

Thus, the power of the high frequency signals that remain inside the waveguide 1 is not reflected by the shorting wall 1*f*, so that an effect of facilitating design of the array antenna device and the like can be obtained.

Second Embodiment

In the first embodiment described above, the example has been indicated in which the waveguide 1 is a rectangular waveguide, but in a second embodiment, an example will be described in which the waveguide 1 is a radial line waveguide.

Figure 3:
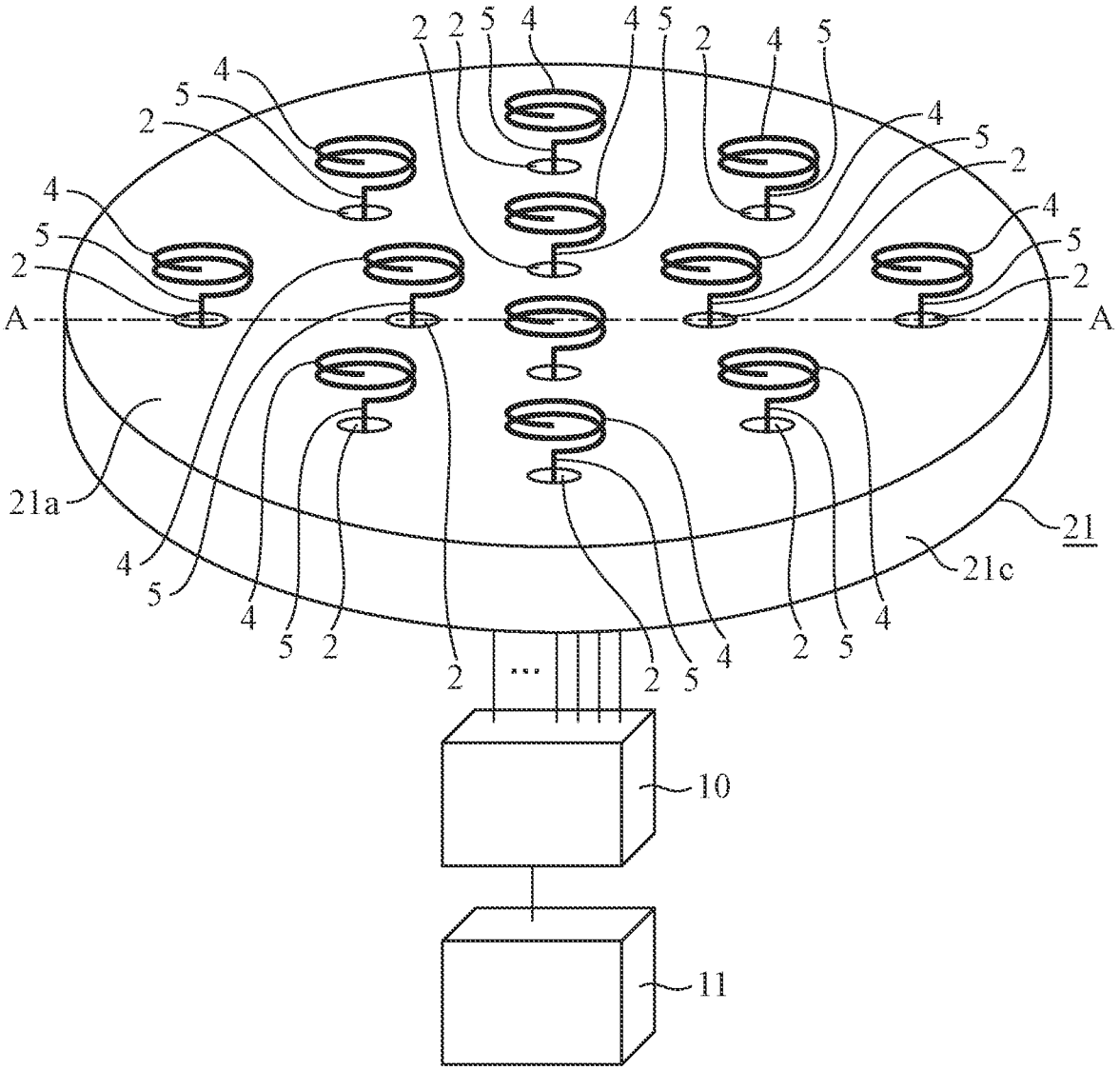
FIG. 3 is a perspective view illustrating an array antenna device according to a second embodiment of the present invention.

FIG. 3 is a perspective view illustrating an array antenna device according to the second embodiment of the present invention.

Figure 4:
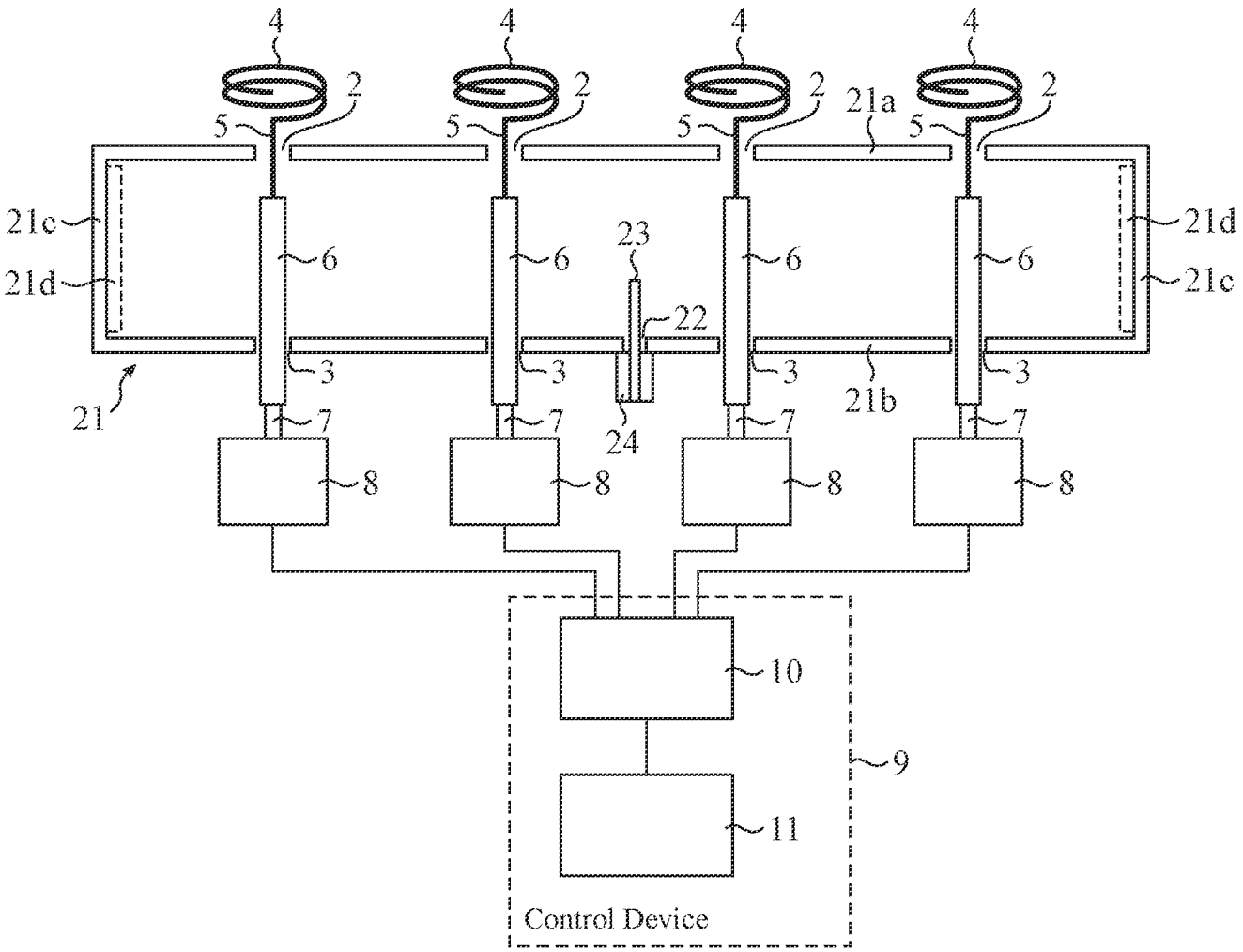
FIG. 4 is a cross-sectional view of the array antenna device taken along line A-A of FIG. 3.

FIG. 4 is a cross-sectional view of the array antenna device taken along line A-A of FIG. 3.

In FIGS. 3 and 4, the same reference numerals as those in FIGS. 1 and 2 indicate the same portions as or equivalent to those in FIGS. 1 and 2, so that descriptions thereof will be omitted.

A waveguide 21 is a radial line waveguide including a first wall surface 21*a* which is a circular flat plate and a second wall surface 21*b* which is a circular flat plate.

As a side wall of the waveguide 21, a shorting wall 21*c* is provided.

A coaxial probe inserting hole 22 is a hole provided in the second wall surface 21*b* of the waveguide 21 so that a coaxial probe 23 can be inserted thereinto.

The coaxial probe 23 is inserted in the coaxial probe inserting hole 22, and is a probe for inputting/outputting high frequency signals inside the waveguide 21.

A coaxial terminal 24 is provided at a lower portion of the second wall surface 21*b* of the waveguide 21 and is a terminal connected to the coaxial probe 23.

Next, operation will be described.

When a high frequency signal is input into the waveguide 21 from the coaxial terminal 24 through the coaxial probe 23, an electromagnetic field distribution mainly including an electric field parallel to the wall surface of the shorting wall 21*c* is generated inside the waveguide 21.

The feed probes 5 of the circularly polarized element antennas 4 are inserted in the waveguide 21 substantially parallel to the shorting wall 21*c* of the waveguide 21, and therefore the feed probes 5 couple with an electric field generated in the waveguide 21.

As a result, a current flows through each feed probe 5, so that power is supplied to the corresponding circularly polarized element antenna 4. Thus, a circularly polarized wave is radiated into space from the circularly polarized element antenna 4.

At that time, phase differences among elements in the circularly polarized waves radiated from the respective circularly polarized element antennas 4 are determined by phase differences in currents flowing through the respective feed probes 5 and differences in physical rotation angles among the respective circularly polarized element antennas 4.

The phase differences in the currents flowing through the respective feed probes 5 are determined by the electromagnetic field distribution inside the waveguide 21 and positions of the respective circularly polarized element antennas 4, and can be obtained by a theoretical method or electromagnetic field simulation, and the like.

The circularly polarized element antennas 4 are each connected to the corresponding rotation shaft 7 via the feed probe 5 and the connection shaft 6, and the rotation shafts 7 are each connected to the corresponding rotation device 8.

Therefore, the control device 9 can individually control the rotation angles of the respective circularly polarized element antennas 4 by controlling the respective rotation devices 8 individually.

Similarly to the first embodiment, the rotation control device 11 of the control device 9 calculates the excitation phase distribution of the array antenna device for forming a desired radiation pattern.

In addition, similarly to the first embodiment, the rotation control device 11 calculates the rotation angles of the rotation shafts 7 corresponding to the excitation phase distribution in consideration of the phase differences in the currents flowing through the respective feed probes 5, and calculates the rotational speeds of the rotation shafts 7 corresponding to a switching time of predetermined radiation patterns.

The rotation control device 11 outputs a command value indicating the rotation angles of the rotation shafts 7 and the rotational speeds of the rotation shafts 7 thus calculated to the rotary drive device 10 through the network interface.

Similarly to the first embodiment, the rotary drive device 10 generates a drive current necessary to rotationally drive each rotation shaft 7 on the basis of the command value output from the rotation control device 11, and outputs the generated drive current to each rotation device 8.

As a result, the respective circularly polarized element antennas 4 are individually rotated at the rotation angles and the rotational speeds calculated by the rotation control device 11, and thereby the respective circularly polarized element antennas 4 are arranged at angles corresponding to the excitation phase distribution necessary for forming a desired radiation pattern.

Thus, the phase differences among elements in the circularly polarized waves radiated from the respective circularly polarized element antennas 4 become identical with the above-described excitation phase distribution, so that the desired radiation pattern is formed.

The desired radiation pattern can be formed by appropriately changing the command value from the rotation control device 11 after manufacturing the array antenna device or during operation of a communication system or a radar system using the array antenna device. This can be achieved by appropriately changing an input value from the user interface of the rotation control device 11, or by appropriately reading information stored in the storage device of the rotation control device 11.

The high frequency signals propagating in the waveguide 21 leak outside the waveguide 21, to no small extent, from the connection shaft inserting holes 3 provided in the second wall surface 21*b* of the waveguide 21.

However, since the diameter of each connection shaft inserting hole 3 is sufficiently small compared to the wavelength of the high frequency signals propagating in the waveguide 21, there are not many high frequency signals leaking outside the waveguide 21 from the connection shaft inserting holes 3. In addition, the positions where the connection shafts 6 and the rotation shafts 7 are connected are outside the waveguide 21.

Therefore, there is almost no coupling between the electric field generated inside the waveguide 21 and the rotation shafts 7. Thus, an array antenna device with high power efficiency can be achieved.

As apparent from the above, according to the second embodiment, the configuration is employed which includes: the waveguide 21 in which the plurality of probe inserting holes 2 is provided in the first wall surface 21*a*, and the plurality of connection shaft inserting holes 3 is provided in the second wall surface 21*b* facing the first wall surface 21*a*; the plurality of feed probes 5 each of which is inserted in one of the probe inserting holes 2, and to one end of each of which the circularly polarized element antenna 4 is connected; the plurality of connection shafts 6 each of which is inserted in one of the connection shaft inserting holes 3, and one end of each of which is connected to the other end of one of the feed probes 5; the plurality of rotation shafts 7 one end of each of which is connected to the other end of one of the connection shafts 6; the plurality of rotation devices 8 each of which rotates one of the rotation shafts 7; and the control device 9 that individually controls rotation of the rotation devices 8. Thus, the phases of the circularly polarized element antennas 4 can be adjusted individually.

In the second embodiment, the example is indicated in which the circularly polarized element antenna 4 is a helical antenna, but there is no limitation thereto. For example, the circularly polarized element antenna 4 may be a patch antenna, a spiral antenna, or a curl antenna.

In the second embodiment, the example is indicated in which the circularly polarized element antennas 4 are arranged at equal intervals concentrically with respect to the center of the waveguide 21.

This is merely an example, and the circularly polarized element antennas 4 may be arranged in an elliptical shape, for example.

In addition, the circularly polarized element antennas 4 may be arranged so that intervals between the adjacent circularly polarized element antennas 4 are different from one another.

Furthermore, the circularly polarized element antennas 4 may be arranged at any position where no physical interference is caused.

In the second embodiment, the example is indicated in which the insertion lengths of the plurality of feed probes 5 inside the waveguide 21 are all the same length, but it is satisfactory as long as the insertion lengths are determined on the basis of the excitation amplitude distribution of the array antenna device and the impedance characteristic at the coaxial terminal 24 of the waveguide 21. Therefore, the insertion lengths of the plurality of feed probes 5 inside the waveguide 21 may be different from one another.

In the second embodiment, the example is indicated in which the shorting wall 21*c* is provided as the side wall of the waveguide 21, but a radio wave absorber 21*d* may be provided on the shorting wall 21*c*.

When the radio wave absorber 21*d* is provided on the shorting wall 21*c*, power of the high frequency signals which have not been radiated from the plurality of circularly polarized element antennas 4 and are remaining inside the waveguide 21 can be absorbed.

Thus, the power of the high frequency signals remaining inside the waveguide 21 is not reflected by the shorting wall 21*c*, so that an effect of facilitating design of the array antenna device and the like can be obtained.

In the second embodiment, the example is indicated in which the waveguide 21 is a radial line waveguide including the first wall surface 21*a* which is a circular flat plate and the second wall surface 21*b* which is a circular flat plate.

Figure 5:
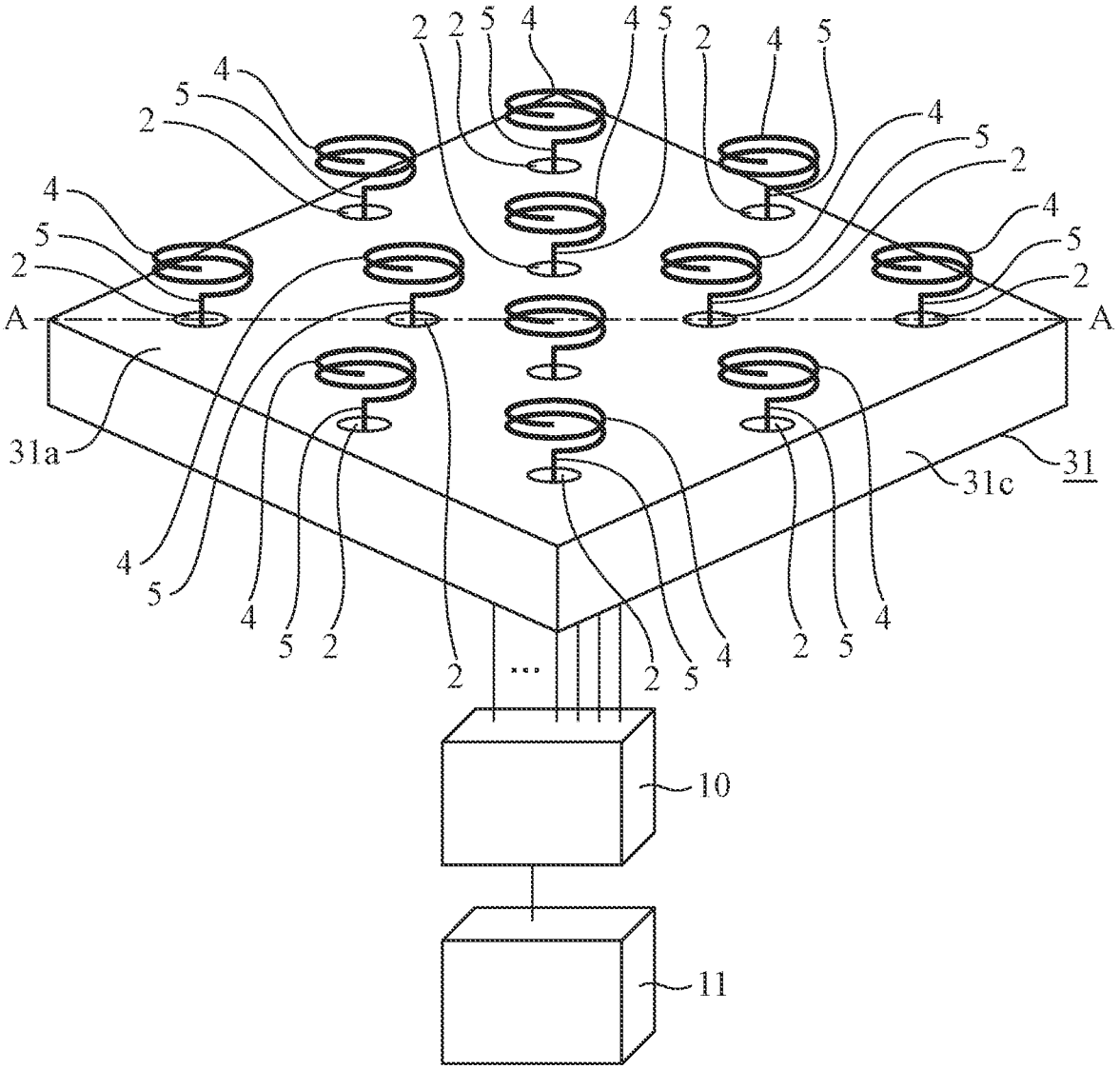
FIG. 5 is a perspective view illustrating another array antenna device according to the second embodiment of the present invention.

This is merely an example, and as illustrated in FIG. 5, a waveguide 31 may be a parallel plate waveguide including a first wall surface 31*a* which is a rectangular flat plate and a second wall surface 31*b* which is a rectangular flat plate, for example.

FIG. 5 is a perspective view illustrating another array antenna device according to the second embodiment of the present invention.

Figure 6:
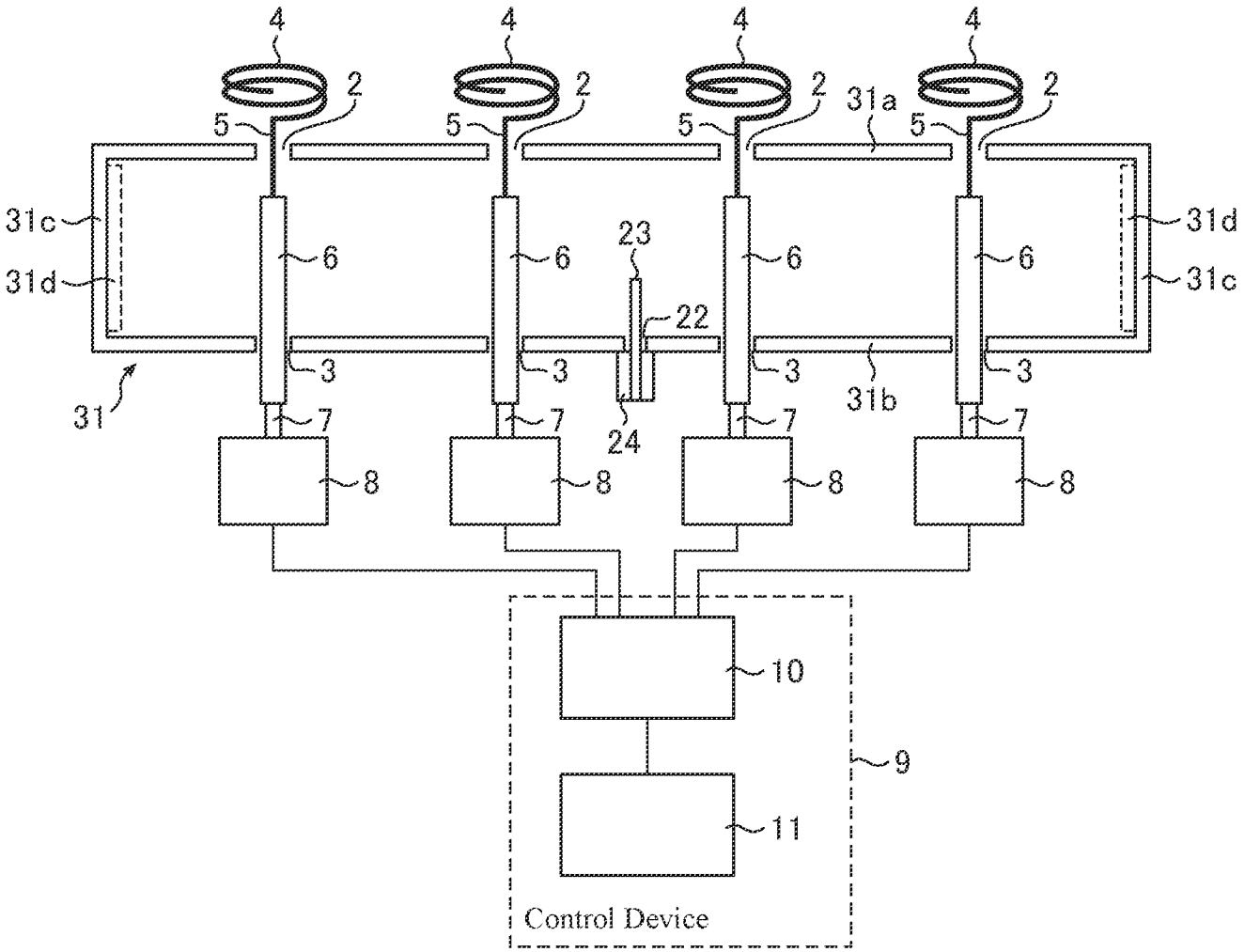
FIG. 6 is a cross-sectional view of the array antenna device taken along line A-A of FIG. 5.

FIG. 6 is a cross-sectional view of the array antenna device taken along line A-A of FIG. 5.

Even when the waveguide 31 is a parallel plate waveguide, a radio wave absorber 31*d* may be provided on a shorting wall 31*c* which is a side wall of the waveguide 31.

Third Embodiment

In a third embodiment, an array antenna device including a polarization conversion plate 41 will be described.

Figure 7:
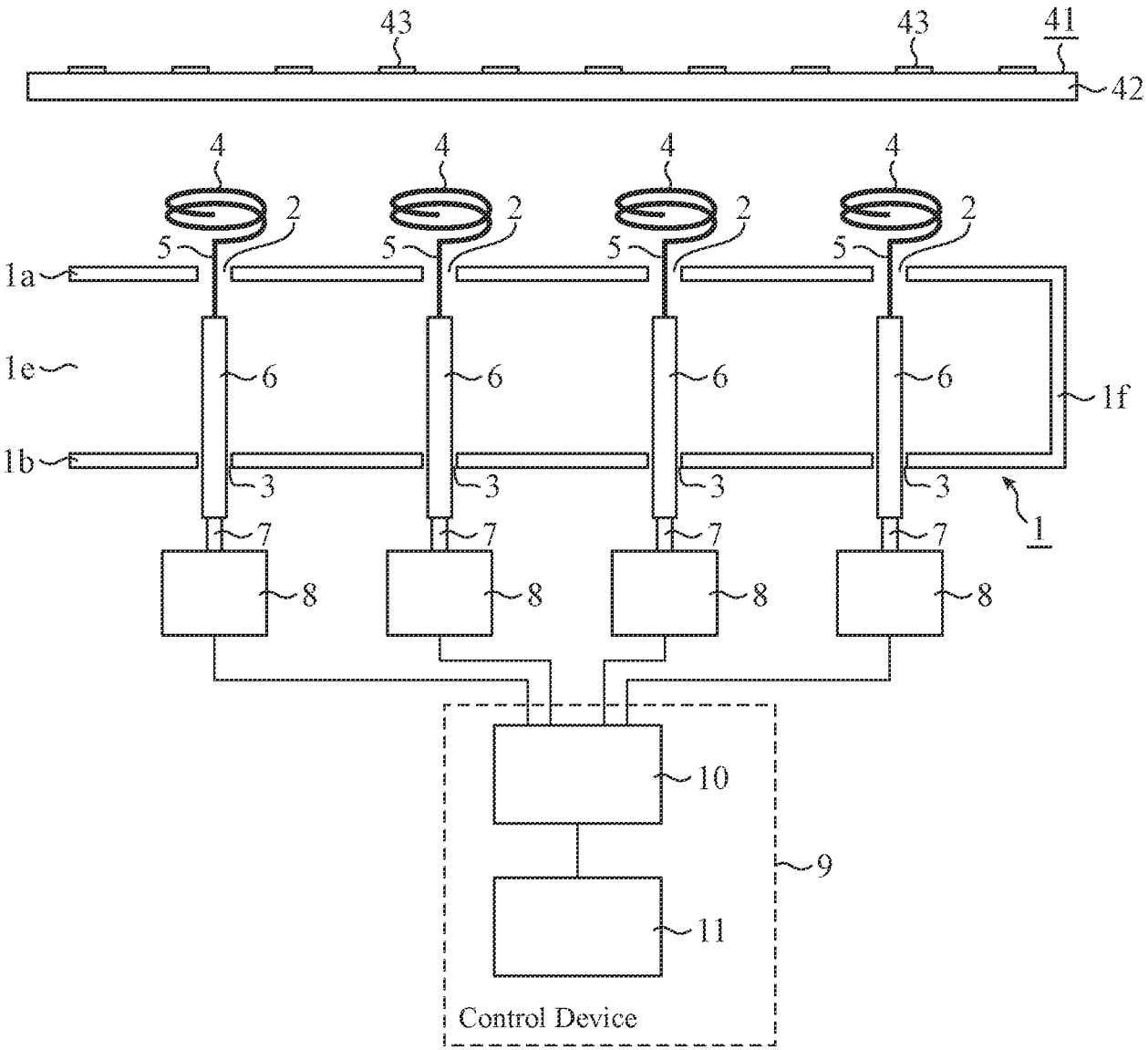
FIG. 7 is a cross-sectional view illustrating an array antenna device according to a third embodiment of the present invention.

FIG. 7 is a cross-sectional view illustrating an array antenna device according to the third embodiment of the present invention. In FIG. 7, the same reference numerals as those in FIGS. 1 and 2 indicate the same portions as or equivalent to those in FIGS. 1 and 2, so that descriptions thereof will be omitted.

The polarization conversion plate 41 is disposed above the circularly polarized element antennas 4 to be separated at a predetermined distance from the circularly polarized element antennas 4 in the figure.

The polarization conversion plate 41 is a polarizer that converts circularly polarized waves radiated from the circularly polarized element antennas 4 into linearly polarized waves to output the linearly polarized waves to space, and converts linearly polarized waves coming from space into circularly polarized waves to output the converted circularly polarized waves to the circularly polarized element antennas 4.

The polarization conversion plate 41 includes a dielectric substrate 42 and a plurality of line conductor patterns 43 being meandering, and the plurality of line conductor patterns 43 is formed on the dielectric substrate 42.

The array antenna device of FIG. 7 indicates the example in which the polarization conversion plate 41 is applied to the array antenna device of FIGS. 1 and 2, but the polarization conversion plate 41 may be applied to the array antenna device of FIGS. 3 and 4, or may be applied to the array antenna device of FIGS. 5 and 6.

Next, operation will be described.

When the array antenna device is used as a transmitting antenna, circularly polarized waves are radiated from the plurality of circularly polarized element antennas 4.

The polarization conversion plate 41 converts the circularly polarized waves radiated from the plurality of circularly polarized element antennas 4 into linearly polarized waves, and radiates the linearly polarized waves into space.

At that time, the phase differences among elements in the linearly polarized waves radiated into space from the polarization conversion plate 41 are not different from the phase differences among elements in the circularly polarized waves radiated from the plurality of circularly polarized element antennas 4, and therefore even when linearly polarized waves are radiated into space from the polarization conversion plate 41, a desired radiation pattern can be formed.

When the array antenna device is used as a receiving antenna, linearly polarized waves are incident on the polarization conversion plate 41.

The polarization conversion plate 41 converts the incident linearly polarized waves into circularly polarized waves, and outputs the circularly polarized waves to the plurality of circularly polarized element antennas 4.

The plurality of circularly polarized element antennas 4 receives the circularly polarized waves output from the polarization conversion plate 41.

As apparent from the above, according to the third embodiment, a configuration is employed which includes the polarization conversion plate 41 that converts circularly polarized waves radiated from the circularly polarized element antennas 4 into linearly polarized waves to output the linearly polarized waves to space, and converts linearly polarized waves coming from space into circularly polarized waves to output the converted circularly polarized waves to the circularly polarized element antennas 4. Consequently, in addition to the effects similar to those in the first and second embodiments, an effect of forming a radiation pattern of linearly polarized waves is achieved.

Fourth Embodiment

In a fourth embodiment, an array antenna device including a plurality of insulators 50 integrally formed with the respective connection shafts 6 will be described.

Figure 8:
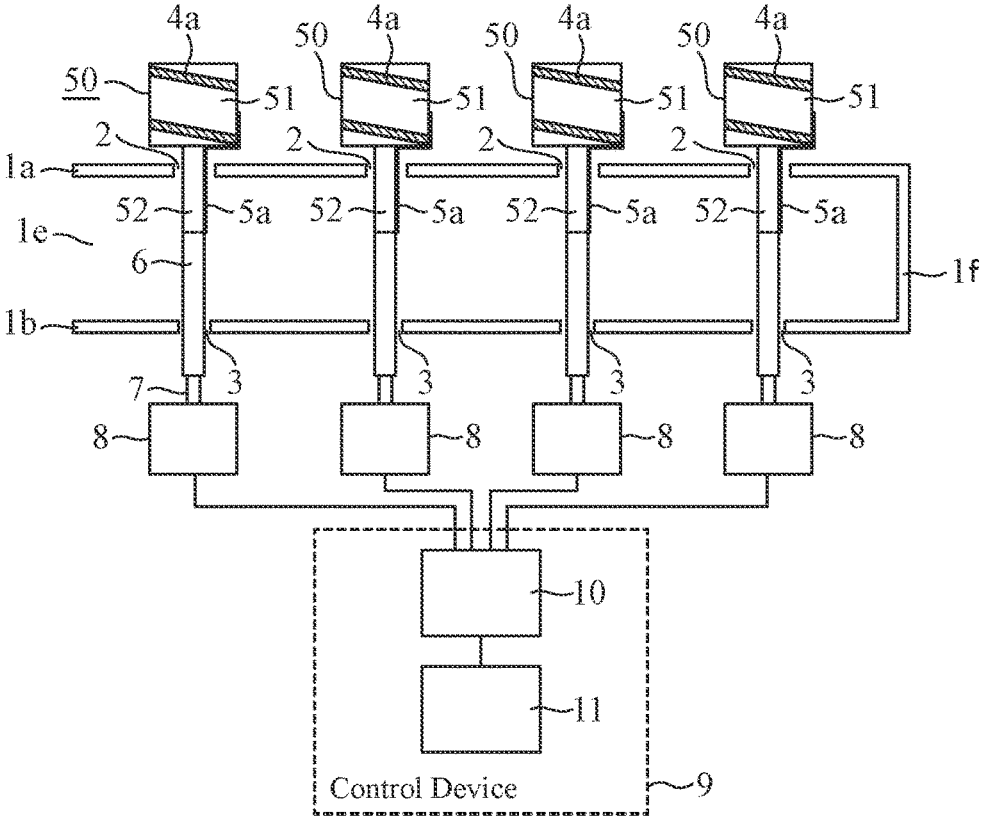
FIG. 8 is a cross-sectional view illustrating an array antenna device according to a fourth embodiment of the present invention.

FIG. 8 is a cross-sectional view illustrating an array antenna device according to the fourth embodiment of the present invention.

Figure 9:
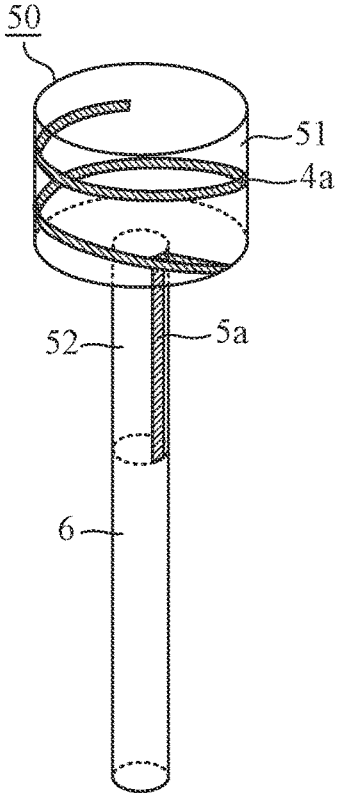
FIG. 9 is a perspective view illustrating an insulator 50 and a connection shaft 6 in the array antenna device illustrated in FIG. 8.

FIG. 9 is a perspective view illustrating the insulator 50 and the connection shaft 6 in the array antenna device illustrated in FIG. 8.

In FIGS. 8 and 9, the same reference numerals as those in FIGS. 1 and 2 indicate the same portions as or equivalent to those in FIGS. 1 and 2, so that descriptions thereof will be omitted.

Each insulator 50 is formed of an insulating substance such as a dielectric.

The insulator 50 is inserted in the probe inserting hole 2 and integrally formed with the connection shaft 6.

In FIGS. 8 and 9, for convenience sake, the boundary between the insulator 50 and the connection shaft 6 is indicated by a broken line, but the insulator 50 and the connection shaft 6 are configured as an integrally formed article.

The insulator 50 includes an antenna unit 51 and a shaft unit 52.

The antenna unit 51 includes the circularly polarized element antenna 4 provided on a surface thereof as a conductor pattern 4*a*.

The shaft unit 52 includes the feed probe 5 provided on a surface thereof as a conductor pattern 5*a*, and forms a shaft integrally with the connection shaft 6.

The conductor pattern 4*a* and the conductor pattern 5*a* are connected to each other.

The array antenna device of the fourth embodiment includes the insulators 50 each integrally formed with the connection shaft 6, and the insulators 50 each include the antenna unit 51 and the shaft unit 52.

The circularly polarized element antenna 4 is provided on the surface of each antenna unit 51 as the conductor pattern 4*a*, and the feed probe 5 is provided on the surface of each shaft unit 52 as the conductor pattern 5*a*.

Accordingly, it is possible to configure the circularly polarized element antenna 4, the feed probe 5, and the connection shaft 6 as one component.

Integral configuration as one component eliminates connection between the circularly polarized element antenna 4 and the feed probe 5 and connection between the feed probe 5 and the connection shaft 6, which improves manufacturability, manufacturing accuracy, and structural robustness of the array antenna device.

As apparent from the above, according to the fourth embodiment, the array antenna device is configured to include the plurality of insulators 50 each of which is inserted in one of the probe inserting holes 2 and integrally formed with one of the connection shafts 6, and each of the insulators 50 includes: the antenna unit 51 that includes each of the circularly polarized element antennas 4 provided on the surface thereof as the conductor pattern 4*a*; the shaft unit 52 that includes each of the feed probes 5 provided on the surface thereof as the conductor pattern 5*a*, and forms a shaft integrally with each of the connection shafts 6. Therefore, the array antenna device according to the fourth embodiment can achieve improvements in manufacturability, manufacturing accuracy, and structural robustness of an antenna, in addition to achieve the effects similar to those in the first and second embodiments.

In the fourth embodiment, the example is indicated in which the configuration including the insulators 50 integrally formed with the connection shafts 6 is applied to the array antenna device illustrated in FIGS. 1 and 2, but there is no limitation thereto. For example, the configuration including the insulators 50 integrally formed with the connection shafts 6 may be applied to the array antenna device illustrated in FIGS. 3 and 4 or the array antenna device illustrated in FIGS. 5 and 6.

Fifth Embodiment

The array antenna device of the fourth embodiment indicates the example in which the conductor pattern 5*a* as the feed probe 5 is provided on the surface of each shaft unit 52.

In a fifth embodiment, a description will be given for an array antenna device which indicates an example in which the conductor pattern 5*a* is provided on a bottom surface 53*a* of a groove 53 provided in each shaft unit 52.

Figure 10:
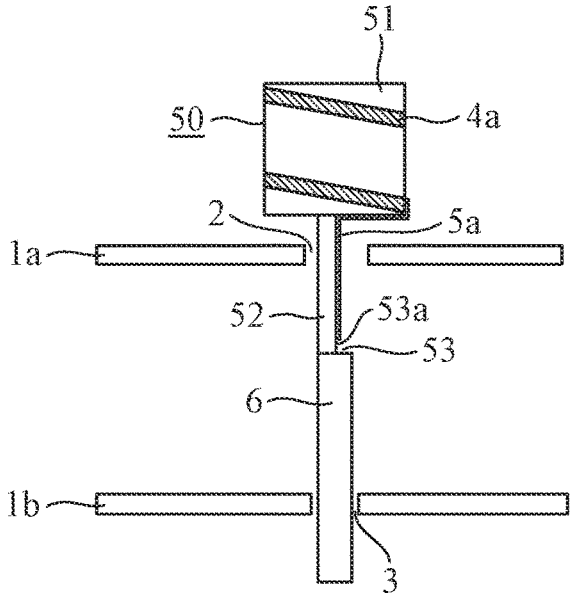
FIG. 10 is a cross-sectional view illustrating the insulator 50 and the connection shaft 6 in an array antenna device according to a fifth embodiment of the present invention.

FIG. 10 is a cross-sectional view illustrating the insulator 50 and the connection shaft 6 in an array antenna device according to the fifth embodiment of the present invention.

Figure 11:
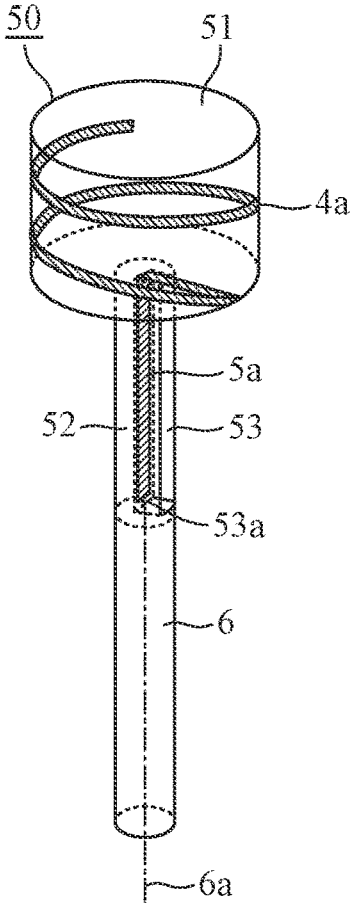
FIG. 11 is a perspective view illustrating the insulator 50 and the connection shaft 6 in the array antenna device illustrated in FIG. 10.

FIG. 11 is a perspective view illustrating the insulator 50 and the connection shaft 6 in the array antenna device illustrated in FIG. 10.

In FIGS. 10 and 11, the same reference numerals as those in FIGS. 1, 8, and 9 indicate the same portions as or equivalent to those in FIGS. 1, 8, and 9, so that descriptions thereof will be omitted.

The groove 53, of which longitudinal direction corresponds to an axial direction, is provided in the shaft unit 52 included in the insulator 50.

The conductor pattern 5*a* as the feed probe 5 is provided on the bottom surface 53*a* of the groove 53.

The position of the bottom surface 53*a* of the groove 53 is the position of a rotation center 6*a* of the connection shaft 6.

In the array antenna device of the fifth embodiment, the conductor pattern 5*a* as the feed probe 5 is provided on the bottom surface 53*a* of the groove 53. In addition, the position of the bottom surface 53*a* of the groove 53 is the position of the rotation center 6*a* of the connection shaft 6.

Therefore, in the array antenna device of the fifth embodiment, a change in the position of the feed probe 5 associated with the rotation of the shaft unit 52 is reduced as compared with the array antenna device of the fourth embodiment, so that it is possible to reduce a change in an antenna characteristic associated with the rotation of the shaft unit 52.

Figure 12:
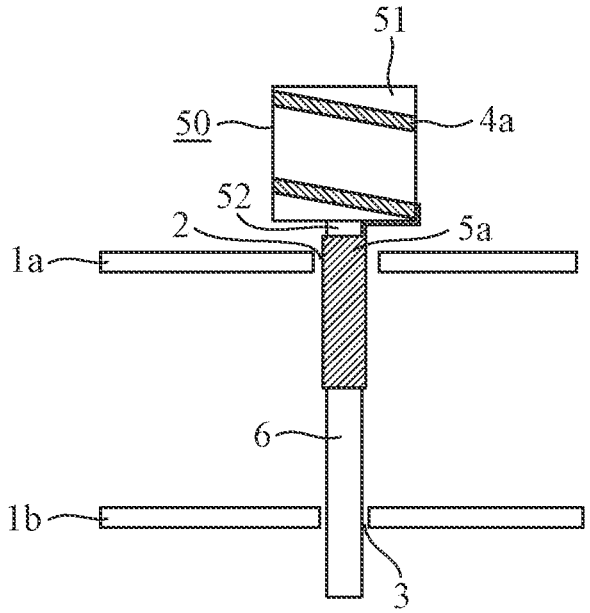
FIG. 12 is a cross-sectional view illustrating the insulator 50 and the connection shaft 6 in another array antenna device according to the fifth embodiment of the present invention.
Figure 13:
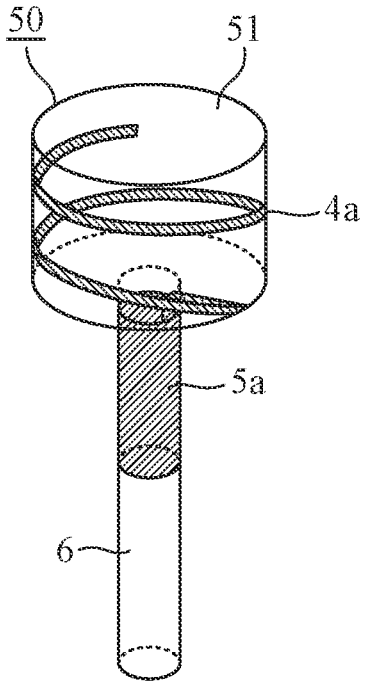
FIG. 13 is a perspective view illustrating the insulator 50 and the connection shaft 6 in the array antenna device illustrated in FIG. 12.

In the array antenna device of the fifth embodiment, the conductor pattern 5*a* as the feed probe 5 is provided on the bottom surface 53*a* of the groove 53, but the conductor pattern 5*a* may surround a part of the outer peripheral surface of the shaft unit 52 as illustrated in FIGS. 12 and 13.

FIG. 12 is a cross-sectional view illustrating the insulator 50 and the connection shaft 6 in another array antenna device according to the fifth embodiment of the present invention.

FIG. 13 is a perspective view illustrating the insulator 50 and the connection shaft 6 in the array antenna device illustrated in FIG. 12.

Figure 14:
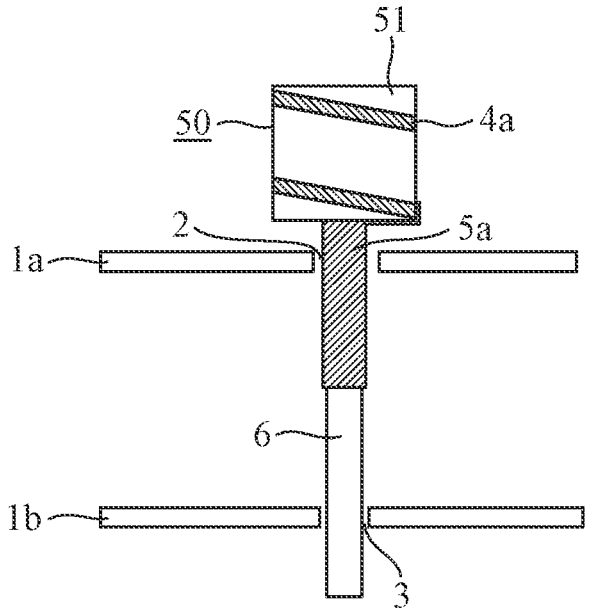
FIG. 14 is a cross-sectional view illustrating the insulator 50 and the connection shaft 6 in another array antenna device according to the fifth embodiment of the present invention.
Figure 15:
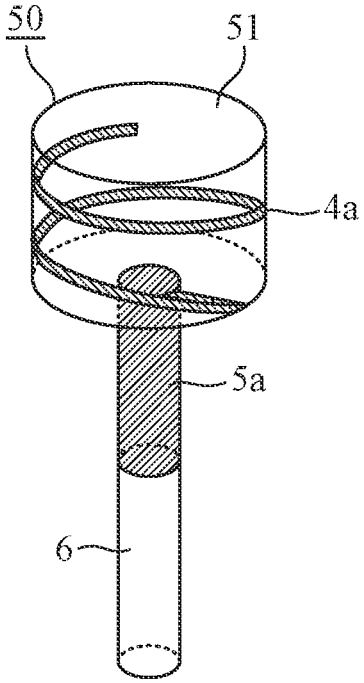
FIG. 15 is a perspective view illustrating the insulator 50 and the connection shaft 6 in the array antenna device illustrated in FIG. 14.

FIGS. 12 and 13 illustrate the array antenna device in which the conductor pattern 5*a* surrounds a part of the outer peripheral surface of the shaft unit 52, but as illustrated in FIGS. 14 and 15, an array antenna device may be employed in which the conductor pattern 5*a* surrounds the entire outer peripheral surface of the shaft unit 52.

FIG. 14 is a cross-sectional view illustrating the insulator 50 and the connection shaft 6 in another array antenna device according to the fifth embodiment of the present invention.

FIG. 15 is a perspective view illustrating the insulator 50 and the connection shaft 6 in the array antenna device illustrated in FIG. 14.

The array antenna device in which the conductor pattern 5*a* surrounds the partial or entire outer peripheral surface of the shaft unit 52 can reduce a change in the antenna characteristic associated with the rotation of the shaft unit 52 similarly to the array antenna device in which the conductor pattern 5*a* is provided on the bottom surface 53*a* of the groove 53.

It should be noted that, in the present invention, each of the embodiments can be freely combined with another embodiment, any constituent element of each embodiment can be modified, or any constituent element can be omitted in each embodiment, within the scope of the invention.

INDUSTRIAL APPLICABILITY

The present invention is suitable for an array antenna device including a plurality of circularly polarized element antennas.

REFERENCE SIGNS LIST

1: waveguide, 1*a*: first wall surface, 1*b*: second wall surface, 1*c*, 1*d*: side wall, 1*e*: feed terminal, 1*f*: shorting wall, 1*g*: radio wave absorber, 2: probe inserting hole, 3: connection shaft inserting hole, 4: circularly polarized element antenna, 4*a*: conductor pattern, 5: feed probe, 5*a*: conductor pattern, 6: connection shaft, 6*a*: rotation center, 7: rotation shaft, 8: rotation device, 9: control device, 10: rotary drive device, 11: rotation control device, 21: waveguide, 21*a*: first wall surface, 21*b*: second wall surface, 21*c*: shorting wall, 21*d*: radio wave absorber, 22: coaxial probe inserting hole, 23: coaxial probe, 24: coaxial terminal, 31: waveguide, 31*a*: first wall surface, 31*b*: second wall surface, 31*c*: shorting wall, 31*d*: radio wave absorber, 41: polarization conversion plate, 42: dielectric substrate, 43: line conductor pattern, 50: insulator, 51: antenna unit, 52: shaft unit, 53: groove, 53*a*: bottom surface.

The invention claimed is:

1. An array antenna device comprising:

a waveguide in which a plurality of probe inserting holes is provided in a first wall surface, and a plurality of connection shaft inserting holes is provided in a second wall surface facing the first wall surface;

a plurality of feed probes each of which is inserted in one of the probe inserting holes, and to a first end of each of which at least one of multiple circularly polarized element antennas is connected;

a plurality of connection shafts each of which is inserted in one of the connection shaft inserting holes, and a third end of each of which is connected to a second end of one of the feed probes;

a plurality of rotation shafts, a fifth end of each of which is connected to a fourth end of one of the connection shafts;

a plurality of rotation devices each of which rotates one of the rotation shafts; and a control device that individually controls rotation of the rotation devices.

2. The array antenna device according to claim 1, wherein the waveguide is a rectangular waveguide, the rectangular waveguide includes two wide wall surfaces and two narrow wall surfaces of which areas are equal to or less than areas of the wide wall surfaces, the first wall surface is a first one of the two wide wall surfaces, and the second wall surface is a second one of the two wide wall surfaces.

3. The array antenna device according to claim 1, wherein a shorting wall is provided at an end portion of the waveguide.

4. The array antenna device according to claim 3, wherein a radio wave absorber is provided on the shorting wall.

5. The array antenna device according to claim 1, wherein each of the first wall surface and the second wall surface in the waveguide is a circular flat plate, and the waveguide is a radial line waveguide.

6. The array antenna device according to claim 5, wherein a shorting wall is provided as a side wall of the waveguide.

7. The array antenna device according to claim 6, wherein a radio wave absorber is provided on the shorting wall.

8. The array antenna device according to claim 1, wherein each of the first wall surface and the second wall surface in the waveguide is a rectangular flat plate, and the waveguide is a parallel plate waveguide.

9. The array antenna device according to claim 8, wherein a shorting wall is provided as a side wall of the waveguide.

10. The array antenna device according to claim 9, wherein a radio wave absorber is provided on the shorting wall.

11. The array antenna device according to claim 1, comprising a polarization conversion plate that converts circularly polarized waves radiated from the at least one of the multiple circularly polarized element antennas into linearly polarized waves to output the linearly polarized waves to space, and converts linearly polarized waves coming from space into circularly polarized waves to output the converted circularly polarized waves to the at least one of the multiple circularly polarized element antennas.

12. The array antenna device according to claim 1, wherein the at least one of the multiple circularly polarized element antennas includes a helical antenna, a patch antenna, a spiral antenna, or a curl antenna.

13. The array antenna device according to claim 1, comprising a plurality of insulators each of which is inserted in one of the probe inserting holes and integrally formed with one of the connection shafts, wherein each of the insulators includes:

an antenna that includes the at least one of the multiple circularly polarized element antennas provided on a surface thereof as a conductor pattern; and a shaft unit that includes each of the feed probes provided on a surface thereof as a conductor pattern, and forms a shaft integrally with each of the connection shafts.

14. The array antenna device according to claim 13, wherein a groove of which a longitudinal direction corresponds to an axial direction is provided in the shaft unit included in each of the insulators, and conductor patterns as the feed probes are provided on a bottom surface of each groove provided in the shaft unit.

15. The array antenna device according to claim 14, wherein a position of the bottom surface of the groove is a position of a rotation center of the connection shaft.

16. The array antenna device according to claim 13, wherein the conductor patterns as the feed probes each surround a partial or entire outer peripheral surface of the shaft unit.

* * * * *